United States Patent [19]

Ward

[11] 4,030,537

[45] June 21, 1977

[54] THIN GAUGE CASTING WHEEL BAND

[75] Inventor: George C. Ward, Carrollton, Ga.

[73] Assignee: Southwire Company, Carrollton, Ga.

[22] Filed: June 25, 1975

[21] Appl. No.: 590,236

[52] U.S. Cl. ..... 164/278

[51] Int. Cl.[2] ..... B22D 11/06

[58] Field of Search ..... 164/278, 87

[56] References Cited

UNITED STATES PATENTS

| | | | |
|---|---|---|---|
| 2,206,930 | 7/1940 | Webster | 164/278 X |
| 3,228,072 | 1/1966 | Hazelett et al. | 164/278 |
| 3,426,836 | 2/1969 | Altenpohl et al. | 164/278 |

FOREIGN PATENTS OR APPLICATIONS

| | | | |
|---|---|---|---|
| 861,273 | 2/1961 | United Kingdom | 164/278 |

*Primary Examiner*—Leondias Vlachos
*Attorney, Agent, or Firm*—Van C. Wilks; Herbert M. Hanegan; Stanley L. Tate

[57] ABSTRACT

A method of and apparatus for continuously casting molten metal are disclosed wherein the flexible band element used to enclose the peripheral groove of the casting wheel of a wheel-band type machine is relatively untensioned and supported along at least a portion of its path of travel by a highly flexible porous support belt through which a coolant may be directed to impinge upon the external surface of the flexible band. The flexible band element, in cooperation with the support belt, provides improved cooling efficiency and a longer life expectancy for the band.

5 Claims, 11 Drawing Figures

THIN GAUGE CASTING WHEEL BAND

BACKGROUND OF THE INVENTION

This invention relates generally to metal founding, and more particularly to an improved method of and apparatus for casting molten metal in a continuous casting machine of the wheelband type.

In a known continuous casting system, molten metal is flowed into a mold formed by enclosing an arcuate portion of the peripheral groove of a rotatable casting wheel with a flexible endless metal band. As the casting wheel rotates, a coolant is applied to the external surfaces of the wheel adjacent the peripheral groove and to the flexible band to prevent excessive heating thereof and to achieve rapid solidification of the molten metal. Typically, a relativley thick (.060 in. or greater) metal band is positioned about and urged into engagement with the flanges of the groove by one of a number of known arrangements of band tensioning, positioning and guide wheels. Many of these arrangements necessitate the bending or flexing of the band about the periphery of one or more band wheels of significantly smaller diameter than that of the casting wheel. Several such arrangements are shown in U.S. Pat. No. 3,596,705, issued Aug. 3, 1971 to John H. Murphy and assigned to the assignee of this invention.

As explained in the aforementioned U.S. Pat. No. 3,596,705, the continual bending and flexing of the band about the casting and band wheels subjects the band to undesirable strain which is proportional both to band thickness and to the diameter of the band wheels. This strain tends to cause rapid deterioration of the band and resultant failure after only a few hours of operation. It will be appreciated by those skilled in the art that the short life expectancy of the band and the time consuming replacement thereof are major problems concerning the efficient operation and maintence of continuous casting machines.

When continuously casting metal in machines of the above-described type, such as, for example, copper, aluminum and steel, it is highly advantageous to solidify the molten metal in as short a period of time as possible in order to maintain a high casting rate. Moreover, when casting metals containing alloying elements, rapid solidification is desirable in order to maintain intermetallic compounds in solid solution and to limit the size of the particles that do precipitate out of solution. However, the low cooling efficiency and nonuniformity of heat transfer inherent in the thick metal bands of prior art casting machines preclude attainment of the high casting rates and metallurgic effects desired. This is especially so if the band is fabricated of a material having a relatively low rate of heat transfer even though coolant is applied to the external band surface at maximum practicable pressure and volume.

It should be apparent, therefore, that to improve the casting rate of continuous casting machines of the type described concomitantly with the life expectancy of the flexible band element, bands formed of thin gauge materials having a high heat transfer rate could be advantageously utilized to achieve such improvements. However, the prior art recognizes several problems in attempting to fabricate the band from thin guage, high heat transfer materials. Notably, one problem encountered when fabricating mold components of high heat transfer rate materials is the typically low structural strength of such materials which adversely affects their useful life, as explained in U.S. Pat. No. 3,464,483, issued Sept. 2, 1969 to Daniel B. Cofer and assigned to the assignee of the present invention. While reducing band thickness would tend to reduce band strain exerted by the band wheels on a band formed of a high heat transfer rate material, the structural strength of the band would, of course, be further diminished so that little advantage in terms of band life could be realized.

A further problem associated with the use of thin gauge band elements for continuous casting machines is explained in U.S. Pat. No. 3,533,463, issued Oct. 13, 1970 to Robert W. Hazelett et al, wherein the patentees recognize the susceptibility of damage to a thin guage band, particularly at the edges thereof, when it is adequately tensioned to prevent leakage of molten metal from between the band and casting wheel groove. It is further noted in the aforesaid Hazelett et at patent that the band wheel flanges used to steer the band into position for enclosing the groove are especially damaging to the edges of a thin guage band.

One prior art method and apparatus for improving band life and casting rate is described in U.S. Pat. No. 3,642,055, issued Feb. 15, 1972 to William Nighman wherein a foraminous wire mesh belt is employed to close the peripheral groove of the casting wheel of a wheel-band type continuous casting machine. Coolant is directed through the openings in the belt to impinge directly upon the molten metal in the groove. The high surface tension of the molten metal is relied upon to prevent the molten metal from flowing through the openings in the foraminous belt. However, at the high casting rates contemplated by the present invention, the surface tension of the molten metal would very likely be insufficient to prevent leakage through the foraminous belt and the resultant danger of metal splatter in the area surrounding the casting machine. Even if leakage could be prevented, there always exists the possibility of obstructing the pores of the foraminous belt with solidified metal, rendering the escape of the vaporized coolant from the casting groove more difficult and thus increasing the danger of explosion. Moreover, the separation of the cast bar from the foraminous belt as the bar exits the casting groove could be hampered because of adherence between the cast bar and foraminous belt as the molten metal in contact with the belt solidifies. A further disadvantage of the apparatus and method described in U.S. Pat. No. 3,642,055 is the resulting poor quality of the cast bar surface which confronts the coarse and irregular surface of the foraminous belt.

SUMMARY OF THE INVENTION

In view of the foregoing, it should be apparent that there still exists a need in the art for a wheel-band type continuous casting machine wherein the flexible band element closing the casting wheel groove has a longer life expectancy than heretofore possible with conventional casting machines. It is, therefore, a primary object of this invention to provide a continuous casting machine which is characterized by an increased band life and resultant high production or casting rate.

More particularly, it is an object of this invention to provide a continuous casting machine having a relatively untensioned flexible band element for closing a portion of the peripheral groove of the casting wheel, means for supporting and urging such band element sealingly against the casting wheel and means for cooling the band element.

Still more particularly, it is an object of this invention to provide a continuous casting machine having a thin gauge band element fabricated of a material having a high heat transfer rate and wherein the means for supporting and urging the band element against the casting wheel includes a highly flexible, porous support belt formed of an open-grid chain or wire mesh material through which a coolant is applied to the band element.

Yet another object of the present invention is to provide a continuous casting machine having a flexible band element fabricated of a non-metallic material wherein the means for supporting and sealingly urging the band element against the casting wheel includes a highly flexible, porous support belt formed of an open-grid material through which coolant is applied to the band element.

Another object of this invention is to provide a continuous casting machine having a thin gauge band formed of a heat resistant material and which is subjected to minimum flexural and tensile stresses to thereby prolong band life.

A further object of the present invention is to provide a method of continuously casting molten metal at high production rates wherein a flexible band element is arranged in relatively untensioned contacting relation about a peripheral portion of a grooved casting wheel, supporting the band element against the casting wheel by means of a tensioned porous belt and applying a coolant to the band element surface through the porous belt to cool the band and solidify the molten metal.

Briefly described, these and other objects of the invention are accomplished in accordance with its apparatus aspects by providing a continuous casting machine comprising a rotatable casting wheel having a peripheral groove formed therein. The groove is closed over a portion of its length by a flexible band element supported and urged into engagement with the casting wheel groove by a highly flexible, open-gridded chain or wire mesh belt which is preferably wider than and substantially less susceptible to flexural and bending stresses than the flexible band element.

In certain of the embodiments of the invention disclosed herein, the flexible band element and its support belt travel along substantially the same path over the casting wheel and band wheel peripheries. The band element is, however, slightly longer than the support belt so that during casting the band is under relatively little tensile stress, the force of the band tensioning wheels being applied primarily in tension to the porous, highly flexible support belt. The portion of the band element closing the groove is under a primarily compressive load exerted radially of the casting wheel by the supporting belt. In casting machine arrangements where necessary, means are provided for taking up slack in the flexible band element and for guiding it along its path of travel. In other embodiments of the invention, the support belt is arranged to travel about the band wheels of variously-configured continuous casting machines in the usual manner, while the flexible band element travles along a different path, only a portion of which coincides with the path of the support belt. As in the previously mentioned embodiments, the band element is relatively untensioned, most of the tensile force being exerted by the band tensioning wheels on the support belt.

Since the support belt is formed of a highly flexible open-grid chain, wire mesh or other suitable material, it is not particularly susceptible to flexural or bending stresses and, consequently, can be expected to have a long life expectancy. Moreover, the support belt may be employed on casting machines having significantly smaller diameter band wheels thereby allowing wheel and band arrangements not heretofore feasible in continuous casting machines. In arrangements having small diameter band wheels, the flexible band element is preferably guided over a path of travel which differs from and has greater radii of curvature than the path of travel of the belt. A flexible band element formed of either a thin gauge high heat transfer metal band or a thin gauge non-metallic band utilized with the highly flexible support belt results in improved cooling efficiency and a substantial reduction of tensile stresses in the band thereby yielding a significant increase in band life. Thus, high casting rates and greater overall operating efficiences are possible.

The method aspects of the invention are accomplished in a wheel-band type continuous casting machine by closing the peripheral groove of the casting wheel with a flexible thin gauge band element, which may be fabricated of a high heat transfer rate material or of a non-metallic material, guiding the band element in a relatively untensioned state over a path of travel about the casting machine and supporting the thin gauge band element by a porous, highly flexible support belt in a relatively tensioned state over at least that portion of the path of travel of the band forming the peripheral groove closure, to thereby urge the band against the casting wheel periphery and prevent leakage of molten metal from the groove. In addition, the method includes the further step of directly applying a coolant to the external surface of the flexible band element through the porous material of the support belt.

With these and other objects, advantages and features of the invention that may become hereinafter apparent, the nature of the invention may be clearly understood by reference to the following detailed description of the invention, the appended claims and to the several views illustrated in the attached drawings wherein:

DETAILED DESCRIPTION OF THE PREFERRED EMBODIMENTS

Figure 1:
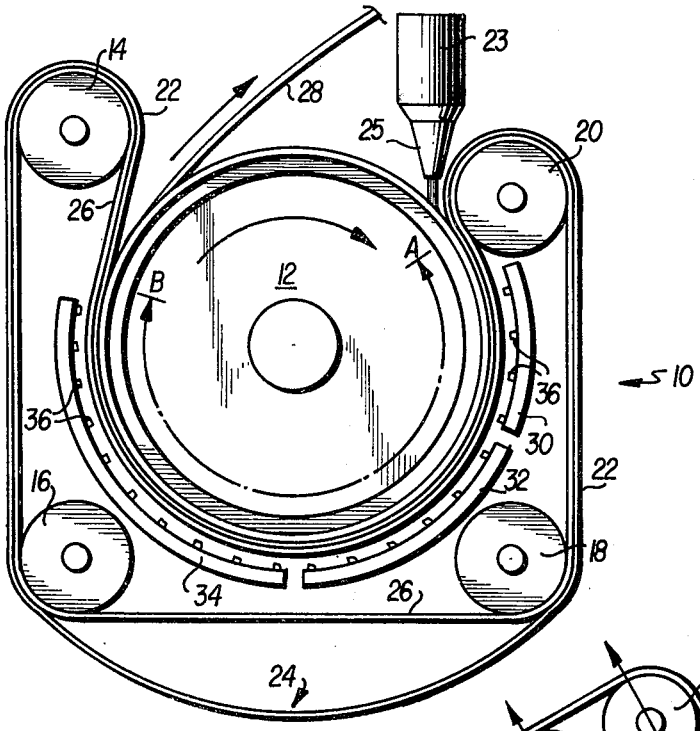
FIG. 1 is a schematic elevation view of one embodiment of a wheel-band type continuous casting machine in accordance with the present invention wherein the support belt and band element travel along substantially the same path.

Referring now in detail to the drawings wherein like parts are designated by like reference numerals throughout, there is illustrated in FIG. 1 a wheel-band type continuous casting machine designated generally by reference numeral 10. The casting machine 10 includes a casting wheel 12 and band guide wheels 14, 16, 18 and 20. An endless flexible band element 22 extends about an arcuate portion of casting wheel 12 and defines a mold in conjunction with a groove (not shown) in the periphery of the casting wheel 12 extending from an inlet point A to an outlet point B. The band 22 is further guided about the band wheels 14, 16, 18 and 20 and is of a length somewhat in excess of the tangential path about the casting machine wheels so as to form a slight catenary 24 between guide wheels 16 and 18. A porous endless support belt 26, preferably constructed of an open-grid or mesh material, is similarly guided along substantially the same path as the band 22 except that the support belt 26 coincides with the tangential path between the guide wheels 16 and 18 as shown. It will be apparent, therefore, that the tension applied by the guide wheel arrangement is exerted primarily upon the support belt 26 and the band 22 is relatively untensioned. Further, closure of the peripheral groove of casting wheel 12 is accomplished by the essentially compressive force applied radially of the casting wheel 12 to the outwardly facing surface of the band 22 over the arcuate portion A–B.

As the casting wheel 12 is rotated in the direction shown, molten metal is flowed from a crucible 23 via spout 25 into the peripheral mold and exists as solidifed bar 28, having traveled over the arcuate portion A–B of the casting wheel 12. A plurality of band headers 30, 32 and 34 are arranged about the arcuate portion A–B of the casting wheel 12 in confronting relation with the support belt 26. Coolant is supplied via a conduit (not shown) to a plurality of nozzles 36 which impinge liquid coolant, such as water or oil, against the surface of band 22 through the open-grid or mesh of the porous belt 26. Other band headers (not shown) are arranged to supply coolant to the external peripheral groove surfaces. An arrangement of a band and wheel cooling system which may be adapted to supply coolant to the band and belt of the present invention is more fully described in U.S. Pat. No. 3,596,702, issued Aug. 3, 1971 to George C. Ward et al and assigned to the assignee of the present invention, which disclosure is incorporated herein by reference.

With the above-described arrangement of the invention, heat may be rapidly transferred from the molten metal through the thin guage band element 22 to the coolant so that the molten metal is quickly solidified. Since the band 22 is relatively thin and untensioned and, further, is supported by the belt 26 over the entire arcuate portion A–B of casting wheel 12, the mechanical and thermal stresses to which the band is subjected are substantially minimized resulting in longer band life.

Figure 2:
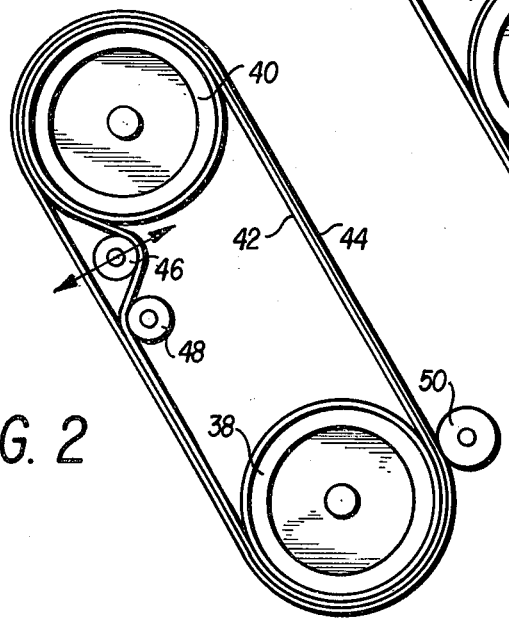
FIG. 2 is a schematic elevation view of an alternate embodiment of a wheel-band continuous casting machine according to the invention wherein the support belt and band element travel along substantially the same path.

FIG. 2 illustrates another embodiment of a continuous casting machine having a lower casting wheel 38 and an upper tension wheel 40. An endless thin gauge band element 42 having a length slightly greater than the tangential path about the wheels 38, 40 is employed to close the groove (not shown) in casting wheel 38. Reinforcing the band 42 along the greater portion of its path of travel is a porous support belt 44, the length of which is approximately equal to the tangential path about the wheels 38, 40. A pair of idler wheels, 46, 48 are positioned near the upper wheel to take up the slack in the longer length band 42 by applying a small tensile force to the band. A band positioning wheel 50 is arranged adjacent the casting wheel 38 to urge the band 42 and belt 44 into engagement with the casting wheel periphery at the point of introduction of molten metal into the casting wheel groove.

Figure 3:
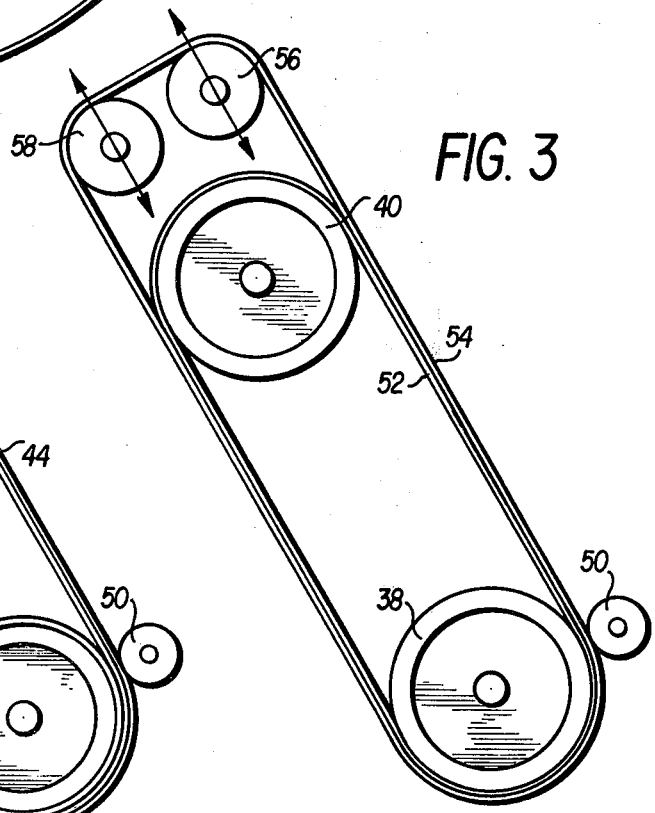
FIG. 3 is a schematic elevation view of a modification of the wheel-band continuous casting machine of FIG. 2.

In FIG. 3 there is shown a casting machine similar to that of FIG. 2 except that a thin gauge band 52 is arranged to follow the tangential path about the casting wheel 38 and upper wheel 40 with substantially no slack. A support belt 54 reinforces the band 52 along the greater portion of its path. It will be appreciated that in this arrangement greater tensile forces may be exerted upon the band 52 than upon the bands of FIGS. 1 and 2. However, the tensile forces in band 52 are still comparatively small with respect to the tensile force exerted upon the support belt 54 by tensioning wheels 56, 58.

Figure 4:
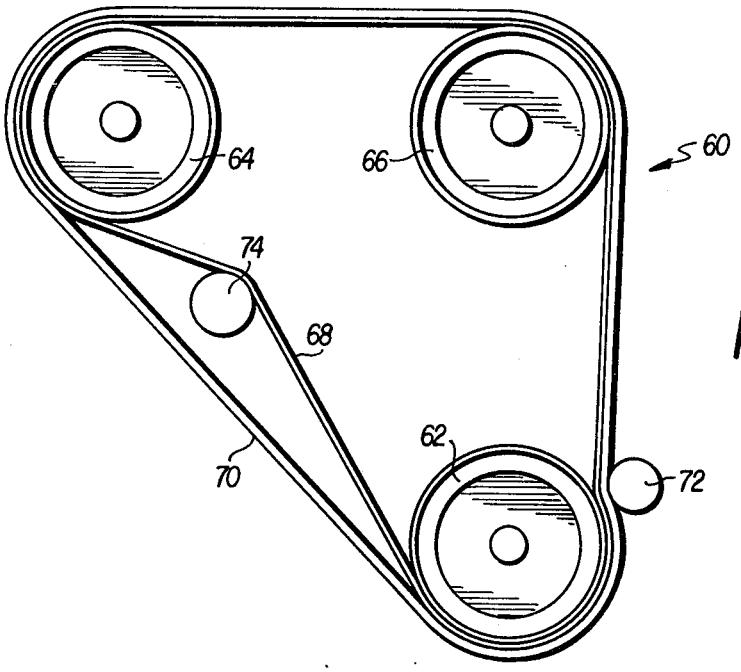
FIG. 4 is a schematic elevation view of another alternate embodiment of a wheel-band continuous casting machine according to the invention wherein the support belt and band element travel along substantially the same path.

The continuous casting machine of the embodiment illustrated in FIG. 4 is designated generally at 60 and includes a rotatable casting wheel 62 having a peripheral groove (not shown), guide wheels 64, 66, an endless thin gauge band element 68 supported by support belt 70, band positioning wheel 72 and takeup wheel 74.

Figure 5:
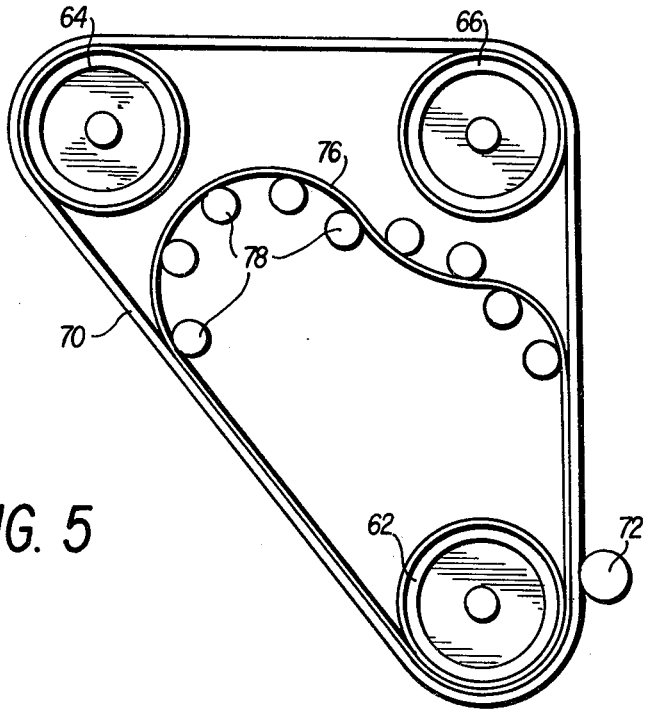
FIG. 5 is a schematic elevation view of the wheel-band continuous casting machine of FIG. 4 wherein the support belt and band element travel along different paths having different lengths.

FIG. 5 illustrates a modification of the casting machine in FIG. 4 wherein the thin gauge band 76 comprises a relatively "free wheeling" loop of a shorter length than the tangential path about the casting wheel 62 and guide wheels 64, 66. The small idler wheels 78 support and guide the free wheeling portion of the band 76.

Figure 6:
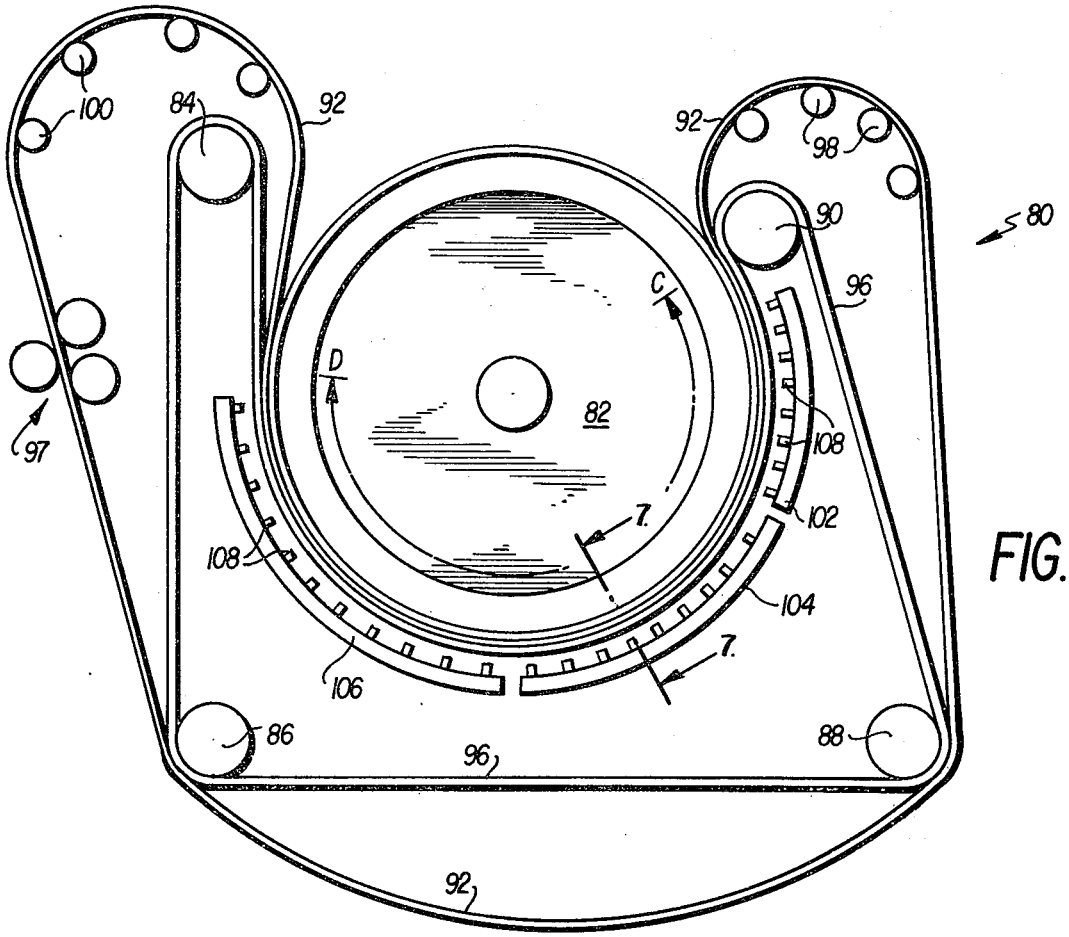
FIG. 6 is a schematic elevation view of a modification of the wheel-band continuous casting machine of FIG. 1.
Figure 7:
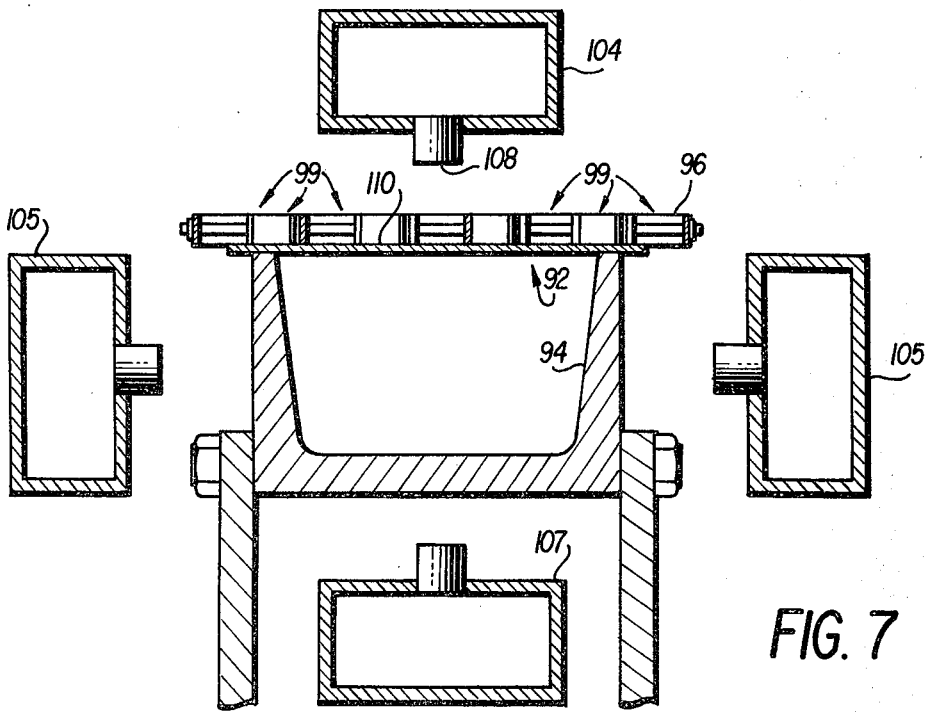
FIG. 7 is a cross-sectional view taken along the line 7–7 of FIG. 6, and illustrates the band element interposed between the casting wheel periphery and the support belt.

Illustrated in FIGS. 6 and 7 is yet another alternative embodiment of a continuous casting machine according to the present invention and is designated generally by the numeral 80. The casting machine 80 includes a casting wheel 82 and guide wheels 84, 86, 88 and 90 which are of substantially smaller diameter than the guide wheels of the apparatus shown in FIG. 1. A thin gauge band element 92 extends about the arcuate portion C–D of casting wheel 82 to form the closure for a casting groove 94 (FIG. 7) formed in the periphery of the casting wheel 82. A support belt 96 of greater flexibility than the band 92 is tangentially guided about the casting wheel 82 by the guide wheels 84, 86, 88 and 90 and urges the band 92 against the periphery of the casting wheel 82 over the arcuate portion of C–D. The small diameter guide wheels 84, 86, 88 and 90 may be in the form of sprockets arranged to engage edge portions of the support belt 96 as idlers or as positively driven elements. If desired, a band straightening roller set 97 may be provided in any convenient location, preferably near the point where the band is guided away from the casting wheel. The purpose of the roller set 97 is to roll out minor discontinuities or wrinkles in the band element 92.

The band 92 is relatively free wheeling except over arcuate portion C–D and is guided away from the casting wheel 82 at points C and D by small idler wheels 98 and 100 over paths having greater radii of curvature than the small diameter wheels 84, 86, 88 and 90 so as to minimize flexural stresses in the band 92. Band headers 102, 104 and 106 are arranged as in the embodiment of FIG. 1 to impinge coolant via nozzles 108 onto the external surface 110 of band 92 through openings 99 in support belt 96. Side coolant headers 105 and casting wheel header 107 shown in FIG. 7 are arranged to supply coolant via their respective nozzles to the external surfaces of the peripheral groove 94.

Figure 8:
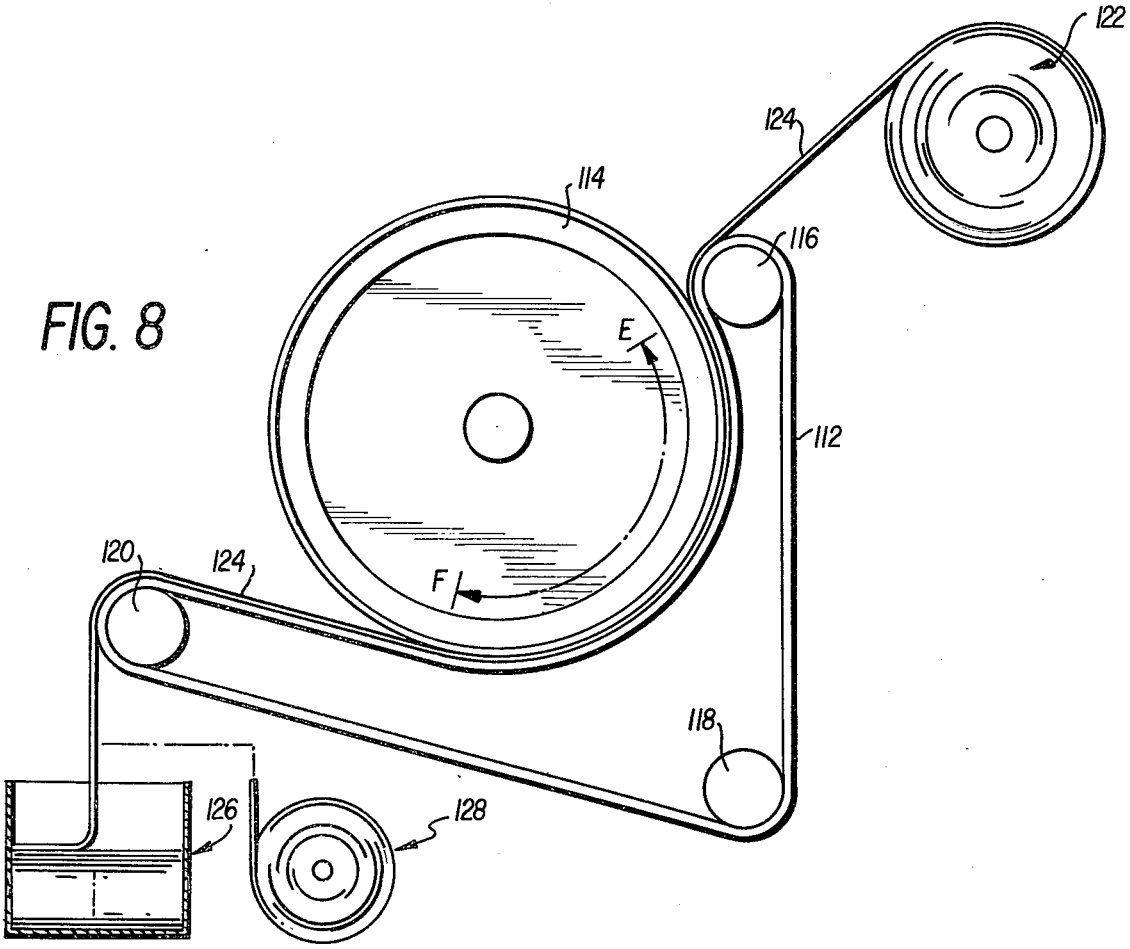
FIG. 8 is a schematic elevation view of another alternate embodiment of a wheel-band continuous casting machine in accordance with the present invention wherein a band element is cycled through the machine from a supply roll to either a waste receptacle or a recycle roll.

FIG. 8 illustrates another embodiment according to the invention wherein a support belt 112 is guided tangentially about a casting wheel 114 and small diameter guide wheels or sprockets 116, 118 and 120. A roll 122 of flexible band material, which may be a either thin gauge metallic material, such as, for example, copper foil, or a non-metallic material, such as asbestos paper or other suitable heat resistant material, is positioned to feed between the periphery of casting wheel 114 and the support belt 112 to form a band 124 for closing the groove in the casting wheel periphery over arcuate portion E–F. The band 124 may be recovered in a receptacle 126 as waste or wound onto another roll 128 for recycling.

Figure 9A:
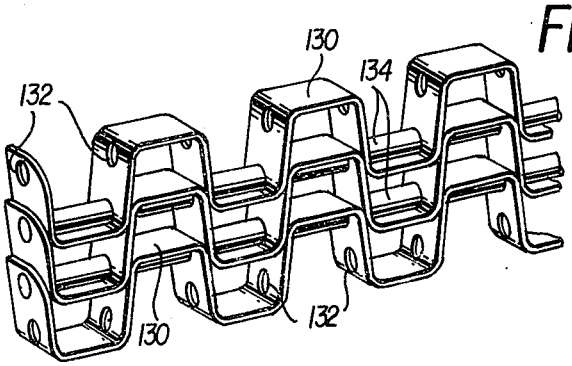
FIGS. 9*a*–9C are fragmentary perspective views of three embodiments of support belt constructions suitable for use in the present invention.
Figure 9B:
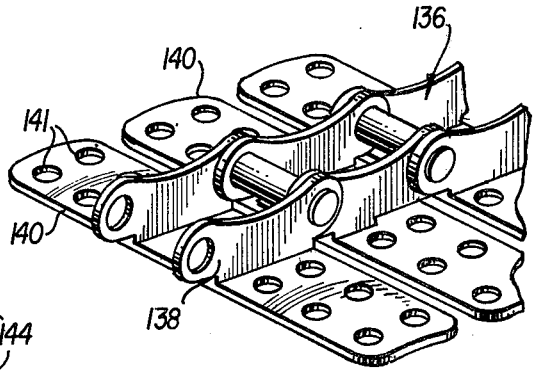
Figure 9C:
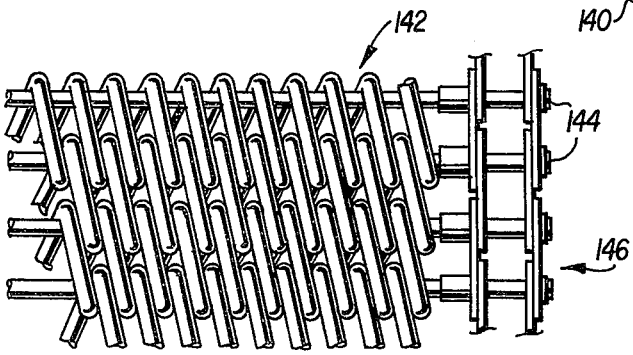

FIGS. 9A–9C illustrate alternative embodiments of open-grid and wire-mesh configurations suitable for use as the support belt of the present invention. FIG. 9A illustrates a portion of an open-grid support belt formed of a plurality of shaped flat wire sections 130 having openings 132 therethrough. The sections 130 are interconnected by rods 134 extending alternately through the openings 132 of a pair of adjacently disposed flat-wire sections 130.

The support belt portion of FIG. 9B comprises a chainlike member 136 formed of links 138, and having attached transversely thereof at each link 138, a perforated plate 140 which may have a slightly curved surface as shown so as to conform to the radius of curvature of the casting wheel with which it is employed. Coolant is applied to the flexible band element through apertures 141 suitably arranged in the plates 140.

FIG. 9C illustrates a portion of a double weave wire mesh 142 reinforced with rods 144 for added strength. At the edges thereof (only one shown) is a roller chain 146 for engagement with a sprocket wheel which may be provided at the ends of the guide wheels of the casting machines of the previously described embodiments.

In view of the foregoing, it should be apparent that there is provided by the present invention a novel wheel-band type continuous casting machine which includes a flexible band element supported by a highly flexible support belt of open-grid construction for the introduction of coolant therethrough so that cooling efficiency is increased thereby making possible higher casting rates. In addition, the novel method of supporting the thin gauge band in a relatively untensioned state yields improved band life expectancies.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. In a machine for continuously casting molten metal wherein a flexible band is guided into closed relationship with an arcuate portion of the peripheral groove of a rotatable casting wheel to form a casting mold, and including means for applying a coolant to the external surface of the flexible band to conduct heat from said band and solidify the molten metal, the improvement comprising a porous support belt arranged to support and urge said band into engagement with the casting wheel peripheral groove over said arcuate portion, said means for applying the coolant being arranged to supply the coolant to said band through said porous support belt, said support belt being guided away from and returned to said peripheral groove by a plurality of guide wheels, said flexible band being wound upon itself to form a roll thereof, and including means for feeding said flexible band from said roll into closed relationship with said peripheral groove at the point on said casting wheel at which said support belt is returned to said peripheral groove.

2. The improvement of claim 1 including means for receiving that portion of the length of said flexible band which has traveled over the arcuate portion of the casting wheel groove and separated from said casting wheel at the point thereon at which said support belt is guided away from said peripheral groove.

3. The improvement of claim 2, wherein said receiving means comprises a further roll upon which said flexible band is wound.

4. The improvement of claim 1 wherein said flexible band is formed of a non-metallic, heat resistant material.

5. The improvement of claim 4 wherein said non-metallic, heat resistant material is asbestos paper.

* * * * *